US006920724B1

(12) United States Patent
Hundley

(10) Patent No.: US 6,920,724 B1
(45) Date of Patent: Jul. 26, 2005

(54) BRACKET FOR A STRUCTURAL PANEL AND A STRUCTURAL PANEL MADE WITH SUCH A BRACKET

(75) Inventor: Jeffrey B. Hundley, Alpharetta, GA (US)

(73) Assignees: Epic Metals Corporation, Rankin, PA (US); Infinity Structures, Inc., Alpharetta, GA (US)

( * ) Notice: Subject to any disclaimer, the term of this patent is extended or adjusted under 35 U.S.C. 154(b) by 0 days.

(21) Appl. No.: 10/034,978

(22) Filed: Dec. 28, 2001

Related U.S. Application Data

(60) Provisional application No. 60/259,779, filed on Jan. 4, 2001.

(51) Int. Cl.[7] ..... E04B 1/98; E04H 9/02

(52) U.S. Cl. ..... 52/167.3; 52/657; 52/656.1; 52/655.1; 52/695

(58) Field of Search ..... 52/167.3, 712, 52/657, 656.1, 655.1, 240, 695

(56) References Cited

U.S. PATENT DOCUMENTS

| | | | | |
|---|---|---|---|---|
| 1,514,577 | A | 11/1924 | Burrell | |
| 1,536,717 | A | 5/1925 | Krekel | |
| 1,574,329 | A | 2/1926 | White | |
| 2,126,511 | A | 8/1938 | Soulé | |
| 2,302,101 | A | 11/1942 | Boydstun | |
| 2,497,887 | A | 2/1950 | Hilpert | |
| 2,856,646 | A | 10/1958 | Latimer et al. | |
| 3,092,407 | A | 6/1963 | Blonder | |
| 3,184,012 | A * | 5/1965 | Fujishima et al. | 52/93.1 |
| 3,380,209 | A * | 4/1968 | Cheskin | 52/223.6 |
| 3,612,291 | A | 10/1971 | Skubic | |
| 4,065,218 | A | 12/1977 | Biggane | |
| 4,267,682 | A | 5/1981 | Fowler et al. | |
| 4,321,776 | A * | 3/1982 | Delight | 52/167.1 |
| 4,441,289 | A * | 4/1984 | Ikuo et al. | 52/167.1 |
| 4,442,989 | A | 4/1984 | Hartmann | |
| 4,716,695 | A | 1/1988 | Alexander et al. | |
| 4,925,330 | A | 5/1990 | Cornish | |
| 5,375,382 | A | 12/1994 | Weidlinger | |
| 5,600,923 | A * | 2/1997 | Riley | 52/79.9 |
| 5,630,298 | A | 5/1997 | Tsai et al. | |
| 5,765,248 | A | 6/1998 | Ono | |
| 5,832,679 | A | 11/1998 | Roth | |
| 5,974,759 | A | 11/1999 | Burger | |
| 6,014,843 | A | 1/2000 | Crumley et al. | |
| 6,158,188 | A * | 12/2000 | Shahnazarian | 52/702 |
| D468,995 | S * | 1/2003 | Ryan et al. | D8/349 |

FOREIGN PATENT DOCUMENTS

| | | | | |
|---|---|---|---|---|
| EP | 79314 A1 | * | 5/1983 | E04B 1/19 |
| GB | 2135417 A | * | 8/1984 | E04B 1/40 |
| SU | 084798 | * | 2/1981 | |

* cited by examiner

*Primary Examiner*—Brian E. Glessner
*Assistant Examiner*—Chi Q. Nguyen
(74) *Attorney, Agent, or Firm*—The Webb Law Firm

(57) ABSTRACT

A bracket for use in fabricating steel structural panels has a first passageway for accepting a connecting member secured to a diametrically opposed bracket to introduce tension between the opposing brackets in the panel. The brackets each have an additional second passageway to accept a connecting member for securing the brackets to a horizontal structural slab or other floor systems. By mating pairs of structural panels with a plurality of horizontal structural slabs or other floor systems, a building may be fabricated.

14 Claims, 6 Drawing Sheets

BRACKET FOR A STRUCTURAL PANEL AND A STRUCTURAL PANEL MADE WITH SUCH A BRACKET

CROSS-REFERENCE TO RELATED APPLICATION

This application claims the benefit of U.S. Provisional Patent Application Ser. No. 60/259,779, filed Jan. 4, 2001, which is incorporated by reference in its entirety.

BACKGROUND OF THE INVENTION

1. Field of the Invention

The present application is directed to structural panels used in buildings and, furthermore, brackets used to assemble such structural panels.

2. Description of the Prior Art

In today's cost-conscious environment, more buildings are being constructed using pre-fabricated wall panels. One type of pre-fabricated wall panel is formed of load-bearing metal studs. Several load-bearing metal stud wall panels may be used in conjunction with one another to support floor and roof structures as part of a complete building. The load-bearing metal stud wall panels are designed to carry the axial loads of a building. These wall panels may also be designed to carry lateral loads (wind load, seismic load, etc.) imposed upon a building. One common design method is to apply a light gauge flat "x-strapping" to one or both sides of the metal stud panels in specifically designed quantities and locations. The x-strap usually consists of light gauge, flat, steel metal strips welded or screwed to the wall panel frame positioned between or on the face of the vertical studs forming an x-shape. However, as a lateral load is applied to the building, one leg of the "x" is placed in tension and carries the lateral load, while the other leg of the "x" goes into compression and can deflect and become wavy. Although great care may be taken to insure the x-straps get installed flat and tight, as the building gets loaded during construction, uneven concrete slide bearing surfaces, as well as incremental settlement, can create compression, deflection and waviness of the flat straps. This can create a structurally ineffective x-strap, as well as a finishing problem when applying drywall panels or other finish mediums. In addition, depending upon the wind loads and the design approach, many times there is a positive net uplift when the x-straps receive a lateral load. This uplift is usually accounted for by some kind of floor-to-floor through-bolt or strap connection at the ends of the x-straps. Some engineers design their own steel connection brackets and bolts, while others utilize various anchors offered by manufacturers. Installing these connections can be a tedious, time-consuming, difficult and expensive task.

Other problems with x-strapping are:

1) they may be cut or damaged by plumbers and electricians after installation;
2) if the concrete slab surface supporting the x-strapped shear panel is uneven and not flat, incremental racking of the x-strapped panel as the building is constructed and loaded causes one strap to pre-load into tension which actually diminishes its ability to carry the lateral load for which it was designed and the other strap experiences compression causing deflection and waviness of the strap;

3) the deflecting x-strapping will cause bulges and/or a finishing problem in the drywall that is applied over the x-strapped wall which are sometimes cut to alleviate the problem; and
4) the x-strapping cannot be tightened or loosened after installation and loading.

Therefore, an object of the present invention is to overcome one or more of these problems.

SUMMARY OF THE INVENTION

One embodiment of the invention is directed to a bracket having a polygonal body with a first side and a second side defining a thickness and a cavity extending therethrough to further define a cavity wall. The body has a first end and a second end adjacent to the first end, wherein the first end and the second end each have mutually perpendicular outer surfaces and each outer surface extends or may be projected to extend to intersect with the other outer surface to form a base corner. An imaginary first penetration line extends from the base corner away from both the first end and the second end and wherein the first penetration line intersects and passes through the cavity wall opposite the base corner. A first passageway extends about the first penetration line through the cavity wall. An imaginary second penetration line extends from and in a direction perpendicular to the outer surface of the first end; and a second passageway extends about the second penetration line through the cavity wall of the first end.

Another embodiment of the subject invention is directed to a structural panel that includes a first track, a second track, and a plurality of vertical studs therebetween connected to and securing the first track to the second track, wherein the intersection of the outermost studs and the first track and the second track define four inner corners. The panel has at least one pair of brackets wherein each bracket of a pair is secured to one of two diametrically opposed inner corners. A cross member is secured at a first end to one of a pair of brackets and at a second end to the other of the pair of brackets and a passageway extends through the bracket for receiving a connecting member to secure the bracket to a building surface, such as a slab. Another embodiment of the invention is directed to a building having a structure with a horizontal load bearing slab, a first structural panel having a first track, a second track, and a plurality of vertical studs therebetween connected to and securing the first track to the second track, wherein the intersection of the outermost studs and the first track and the second track define four inner corners, at least one pair of brackets wherein each bracket of a pair is secured to one of two diametrically opposed inner corners; and a cross member secured at a first end to one of a pair of brackets and at a second end to the other of the pair of brackets. A passageway extends through the bracket for receiving a connecting member. A connecting member extends through the slab and through the passageway of the bracket to secure the panel to the slab.

Another embodiment of the invention is directed to a building having a structure with a horizontal load bearing slab, a first structural panel having a first track, a second track, and a plurality of vertical studs therebetween connected to and securing the first track to the second track, wherein the intersection of the outermost studs and the first track and the second track define four inner corners, at least one pair of brackets wherein each bracket of a pair is secured to one of two diametrically opposed inner corners; and a cross member secured at a first end to one of a pair of brackets and at a second end to the other of the pair of brackets. A passageway extends through the slab and through the passageway of the bracket to secure the panel to the slab.

Another embodiment of the invention is directed to a method for fabricating a building using prefabricated steel panels comprising the steps of:

a) securing a bracket within each inner corner of a steel panel defined by a first track, a second track and the outermost studs of a plurality of vertical studs between the first track and the second track and connecting each bracket to a diametrically opposing bracket with a tension adjustable connection to form a first panel assembly;

b) repeating step a) to form a second panel assembly;

c) positioning the first panel assembly on one side of a first horizontal slab;

d) positioning a second panel assembly on the other side of the horizontal slab; and e) securing the first panel assembly to the second panel assembly using a connecting member extending through the slab and connected to one bracket in each panel assembly.

Yet another embodiment of the invention is directed to a method for installing a structural building panel involving the steps of:

a) securing at least one panel to a support surface;

b) attaching to a top surface of the panel structural decking;

c) passing threaded connecting members from the panel through the decking;

d) pouring concrete on the decking and embedding upper ends of the threaded connecting members in the concrete;

e) waiting for the concrete to partially harden to define a concrete surface; and f) then rotating the threaded connecting members so they pass through the concrete; thereby providing an arrangement whereby additional panels may be placed upon the concrete surface and attached to the upper ends of the connecting members to secure the panel to the concrete surface.

DETAILED DESCRIPTION OF THE INVENTION

Figure 1:
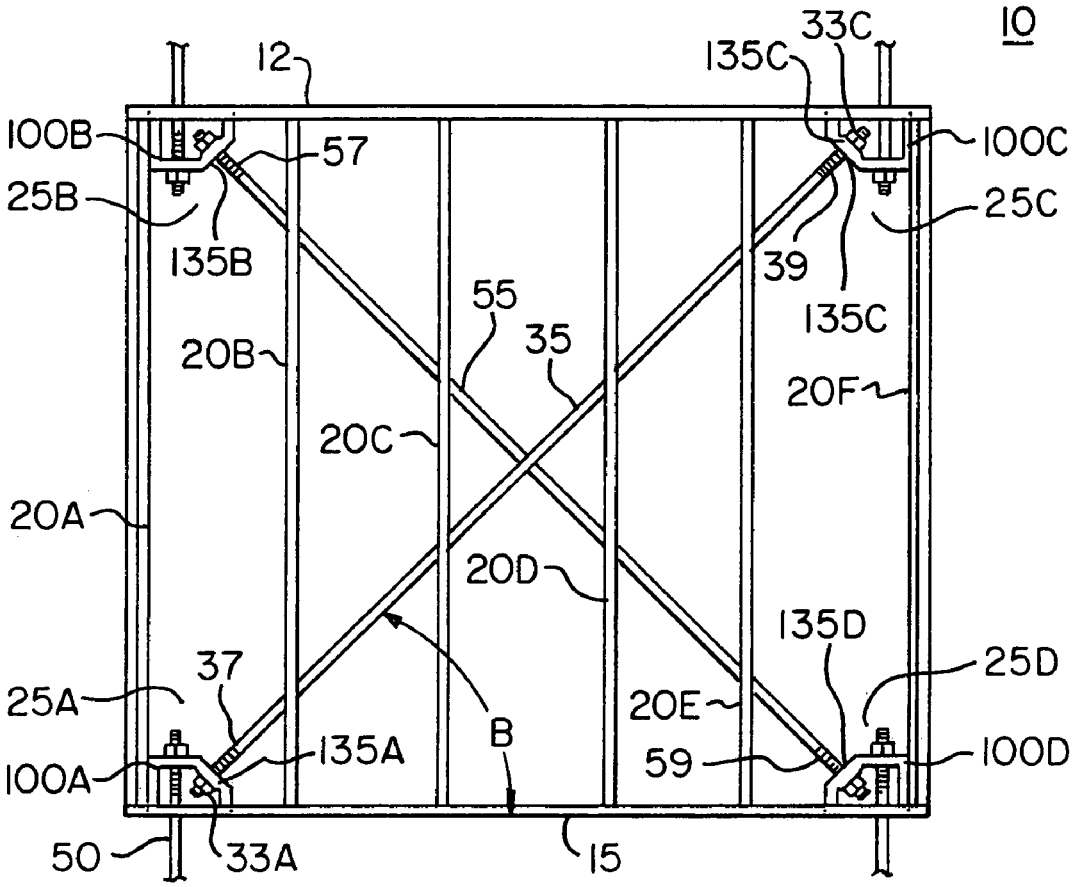
FIG. 1 is an elevational view of a panel made in accordance with the subject invention.

FIG. 1 illustrates a structural panel 10 that includes a first track 12 and a second track 15. A plurality of studs 20A–20F is connected to and secures the first track 12 to the second track 15. The intersection of the outermost studs 20A, 20F with the first track 12 and the second track 15 defines four inner corners 25A–25D. Brackets 100A, 100B, 100C and 100D are secured within inner corners 25A–25D, respectively. A cross member 35 is secured at one end 37 to one bracket 100A of a pair of brackets 100A, 100C and is secured at a second end 39 to the other bracket 100C of the pair. Another cross member 55 is secured at one end 57 to one bracket 100B of a pair of brackets 100B, 100D and is secured at another end 59 to the other bracket 100D of the pair. Each cross member 35, 55 passes through openings (not shown) extending through each stud 20B–20E. As illustrated in FIG. 1, cross member 35 is in a different plane relative to cross member 55 such that the cross members 35, 55 do not interfere with one another. Each cross member 35, 55 is typically a cylindrical metal rod. It should be appreciated that each of the brackets 100A, 100B, 100C and 100D has similar features and that hereafter, unless noted otherwise, the details described with respect to bracket 100A will be identical to those details of the other brackets 100B, 100C and 100D. Panel 10 may have two pairs of brackets defined by brackets 100A, 100C and brackets 100B, 100D.

Each bracket 100A–100D is welded to one of either the first track 12 or the second track 15 and to an adjacent outermost stud 20A, 20F.

For simplicity, the following discussion will be directed to bracket 100A with the understanding that the same features apply to remaining brackets 100B, 100C and 100D. Passageway 150A and 145A (FIG. 2) extends through bracket 100A for receiving a connecting member 50 to secure the bracket 100A to a building slab (not shown). End 37 of cross member 35 is threaded and extends through passageway 135A of bracket 100A (as shown in FIG. 1). The cross member 35 is secured to the bracket 100A with a mating nut 33A. The same arrangement holds true for bracket 100C. End 39 of cross member 35 is threaded and extends through bore 135C in the bracket 100C and is secured to the bracket 100C with a mating nut 33C. The tension in cross member 35 may be adjusted by tightening or loosening the nuts 33A, 33C against the brackets 100A, 100C.

Figure 2:
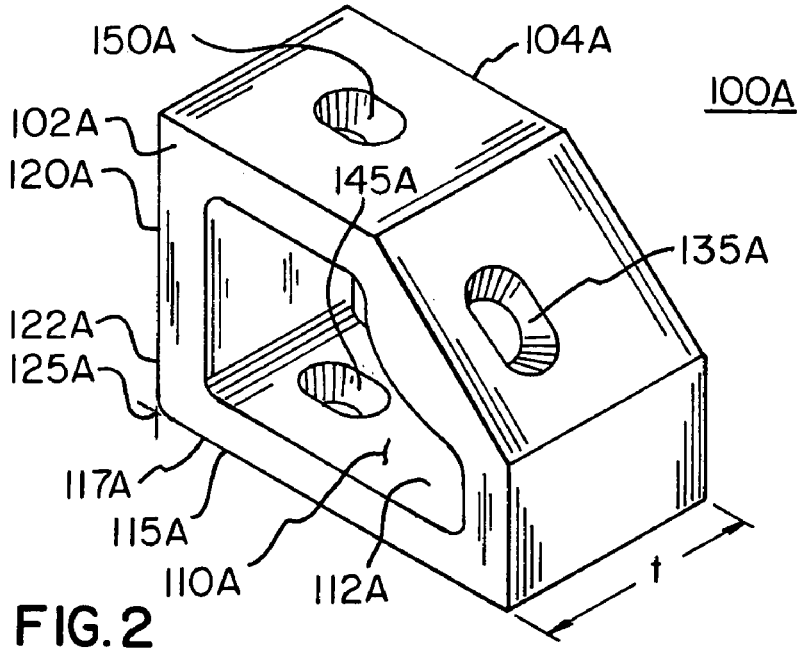
FIG. 2 is a perspective view of a bracket made in accordance with the subject invention.

Directing attention to FIG. 2, bracket 100A is illustrated and will be discussed with the understanding that brackets 100B–100D are identical and merely attached to different inner corners 25A–25D within the panel 10.

Bracket 100A is comprised of a polygonal body with a first side 102A and a second side 104A defining a thickness t with a cavity 110A extending therethrough to further define a cavity wall 112A.

First end 115A and second end 120A, which is adjacent to the first end 115A, each have mutually perpendicular outer surfaces 117A, 122A. Furthermore, each outer surface 117A, 122A extends or may be projected to extend to intersect with the other outer surface 117A, 122A to form a base corner 125A.

Figure 3:
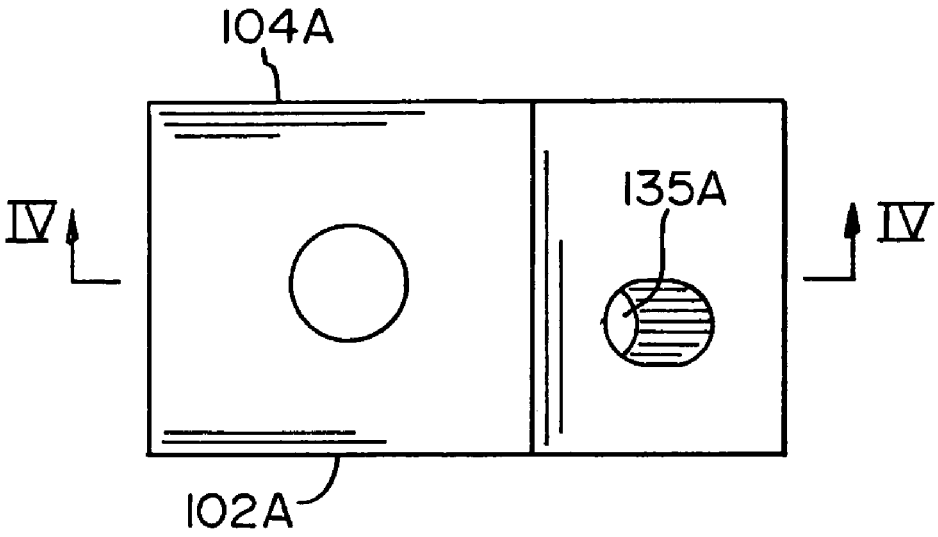
FIG. 3 is a top view of the bracket illustrated in FIG. 2.
Figure 4:
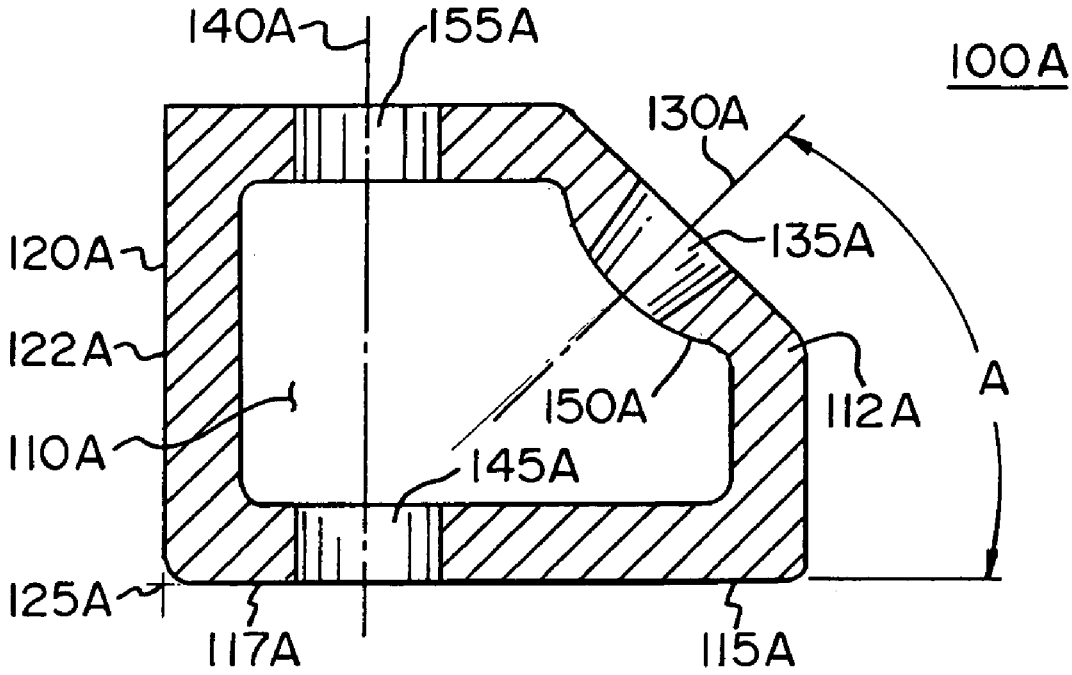
FIG. 4 is a sectional view along arrows IV—IV in FIG. 3.

Directing attention to FIGS. 3 and 4, an imaginary first penetration line 130A extends from the base corner 125A away from both the outer surface 117A of the first end 115A and the outer surface 122A of the second end 120A. The first penetration line 130A intersects and passes through the portion of the cavity wall 112A opposite the base corner 125A. The first passageway 135A extends about the first penetration line 130A through the cavity wall 112A.

Furthermore, an imaginary second penetration line 140A extends from and in a direction perpendicular to the outer surface 117A of the first end 115A. A second passageway 145A extends about the second penetration line 140A through the cavity wall 112A from the outer surface 117A of the first end 115A. The imaginary first penetration line 130A forms an angle A of preferably between 30 to 60° with the outer surface 117A of the first end 115A. When each of the brackets 100A–100D are equidistant from one another, then the preferred angle A is 45°.

As previously mentioned, and as illustrated in FIG. 1, each cross member 35, 55 is secured to a bracket 100A–100D by nuts 33A–33D at the ends of each cross member 35, 55. Although the angle A for each bracket remains constant, depending upon the ratio of lengths of the first track 12 and the second track 15 with the studs 20A–20F, the angle B (FIG. 1) the cross members 35, 55 make with the brackets 100A–D may vary. As an example, if the studs 20A–F have a shorter length than shown in FIG. 1, but the first track 112 and second track 115 retain their length, then the angle B created by cross member 35 with the outer surface 117A of bracket 100A would be smaller than that instance in which the studs 20A–F have a length equal to that of the first track 12 and second track 15. Depending upon the ratio of those lengths, the angle B may have a different value.

Referring to both FIG. 1 and FIG. 4, to accommodate the multitude values of angles B, the cross member 35 may form with the bracket 100A, the cavity wall 112A surrounding the first passageway 135A has a convex shape as illustrated by reference numeral 150A. By utilizing the convex shape 150A, the nut 33A (FIG. 1) or, if a washer is sandwiched between the nut 33A and the convex shape 150A, the washer will contact the cavity wall 112A along a tangential line and over a wide range of angles B formed between the cross member 35 and the outer surface 117A of the first end 115A.

As illustrated in FIG. 4, the bracket 100A is made up of a pentagon. Additionally, as illustrated in FIG. 4, the cavity 110A may have five sides. As will be further explored in the discussion of FIGS. 7, 9, 10 and 11, the brackets may also have a polygonal body with the shape of a rectangle or a triangle and the cavity may have the shape of a rectangle or a circle.

Directing attention again to FIG. 4, the bracket 100A may further include a third passageway 155A through the cavity wall 112A opposite the second passageway 145A and about the second penetration line 140A.

As a general matter, after a panel 10 is installed within a building, the surface of the panel is covered with drywall and the appropriate accessories are attached. To minimize the chance of mechanical interference between the cross members 35, 55 and any accessories that may be mounted upon or within the drywall of the panel, the cross members 35, 55 are preferably recessed within the panel 10 as far as possible. Directing attention to FIG. 3, the first passageway 135A may be biased toward the first side 102A. This bias permits each cross member 35, 55 to be positioned in a different plane relative to the other cross member, as seen in FIG. 1. As an example, and again with reference to FIG. 1, brackets 25A and 25C are oriented within the panel 10 such that the first passageway 135A (FIG. 2) in bracket 25A and the corresponding first passageway 135C in bracket 25C are positioned toward the front face of the panel 10 while the corresponding first passageway 135B of bracket 25B and first passageway 135D of bracket 25D are positioned toward the rear face of the panel 10. As a result, the cross members 35, 55 do not physically interfere with one another at the center of the "x" shape they form.

Because of the range of angle B, the diameter of the first passageway 135A is greater than the diameter of the cross member 35. In the alternative and, as illustrated in FIG. 4, it is entirely possible for the diameter for the first passageway 135A to have a configuration that tapers down as the passageway 135A extends from the outside of the bracket 100A to the cavity 110A.

Figure 5:
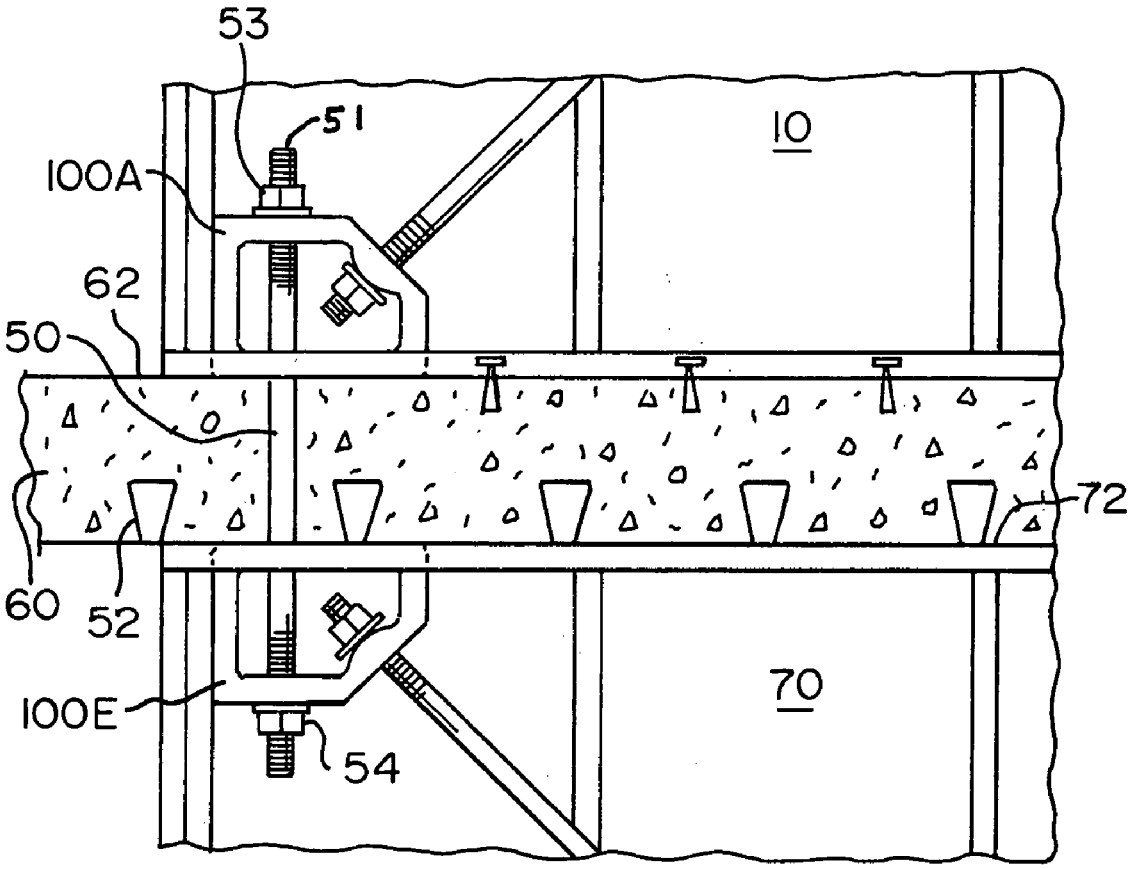
FIG. 5 is an elevational view of a portion of a structure having two panels and a slab attached thereto in accordance with the subject invention.

Directing attention to FIG. 5, the panel 10 may be mounted upon a horizontal structural slab 60 and secured thereto through a connecting member 50 extending through the bracket 100A and into the horizontal slab 60. Additionally, a second panel 70 may be mounted upon the underside of the horizontal slab 60 using another bracket 100E similar to the bracket 100A and secured to the same connecting member 50. Nuts 53, 54 secure each bracket 10A, 100E to the connecting member 50. The horizontal structural slab 60 can be, but is not limited to, a composite slab such as the EPICORE® composite slab system manufactured by EPIC Metals Corporation of 11 Talbot Avenue, Rankin, Pa. 15104. The present invention can also be used with other types of horizontal slabs, or floor systems, such as those utilizing wood joists, metal cee joists, steel bar joists and pre-cast concrete slabs. A horizontal slab 60 may include a metal profile member 52 on which concrete is poured to form the horizontal slab 60. If the panel 10 rests upon the upper side of a horizontal slab and no panels will be secured under the horizontal slab, such as a slab-on-grade or a base level slab, then the panel 10 may be secured to the horizontal slab using concrete anchors as opposed to a connecting member 50 acting as a concrete anchor. The concrete anchors may include epoxy types and may be laid within concrete or may be secured within other material of the horizontal slab. Additionally, the connecting member 50 may be secured within the horizontal slab 60 by permitting the slab, when it is comprised of poured concrete, to harden around the connecting member 50 or, in the alternative, securing the connecting member 50 through a bore extending through the slab 60 using, for example, epoxy to anchor it.

Figure 6:
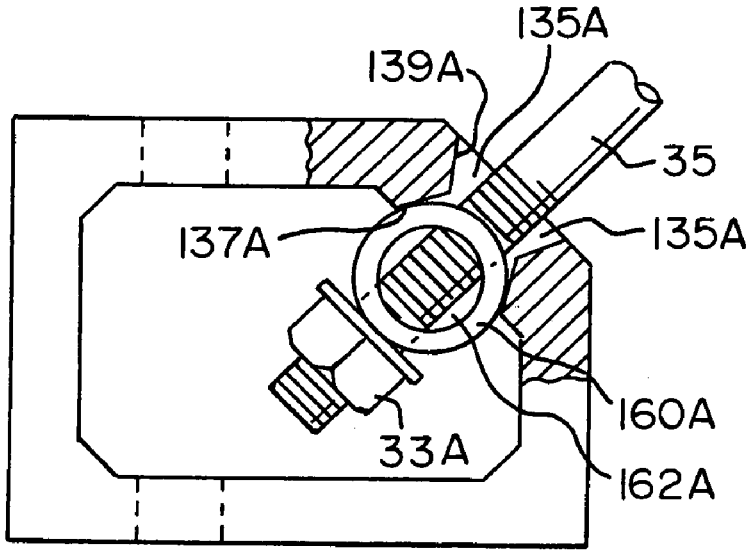
FIG. 6 is an elevational view of an alternate embodiment of a bracket made in accordance with the subject invention.

FIG. 6 illustrates another design that provides tangential contact to nut 33A as it engages the cross member 35. In particular, the first passageway 135A has inwardly tapered walls 137A which accommodate a cylindrical member 160A having a bore 162A therethrough suitable to accept the cross member 35. The cylindrical member 160A provides a convex surface for the nut 33A so that it may contact along a point of tangency against the cylindrical member 160A over a wide range of angles B for the cross member 35. This cylindrical member 160A may instead be a hillside washer. It should also be noted that the first passageway 135A has a second tapered wall 139A that permits motion along a range of angles B for the connecting member 35.

It was previously mentioned that, while bracket 100A having a polygonal body with the shape of a pentagon with a cavity 110A that may have five sides, other configurations are possible.

Figure 7:
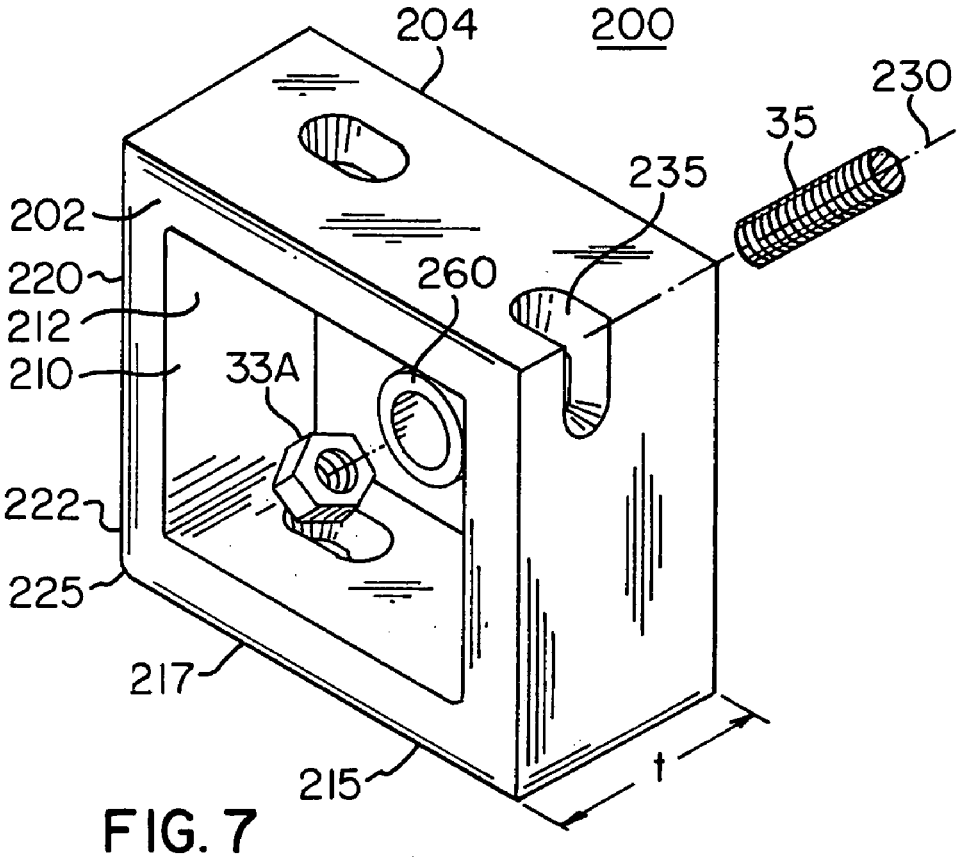
FIG. 7 is a perspective view of yet another alternate embodiment of a bracket made in accordance with the subject invention.

FIG. 7 illustrates a bracket 200 having a first side 202 and a second side 204 with a thickness t therebetween. The features of bracket 200 are similar to those features of bracket 100A with the exception of the overall shape and the details of the first passageway 235. The bracket 200 is generally rectangular in shape and the cavity 210 defines a similar rectangle having a cavity wall 212. The first end 215 of the bracket 200 has an outer surface 217, while the second end 220 of the bracket 200 has an outer surface 222. The outer surface 217 and the outer surface 222 intersect to form a base corner 225. The first passageway 235 extends through the cavity wall 210 in a region of the cavity wall defined by an imaginary first penetration line 230 which extends from the base corner 225 away from both the first end 215 and the second end 220. The first penetration line 237 intersects and passes though the cavity wall 212 opposite the base corner 225 to form an angle with the outer surface 217 of the first end 215 of between 30 to 60° similar to angle A illustrated in FIG. 4. To provide a tangential surface upon which nut 33A may rest, once again a hillside washer or a cylindrical member 260 is introduced.

Figure 8:
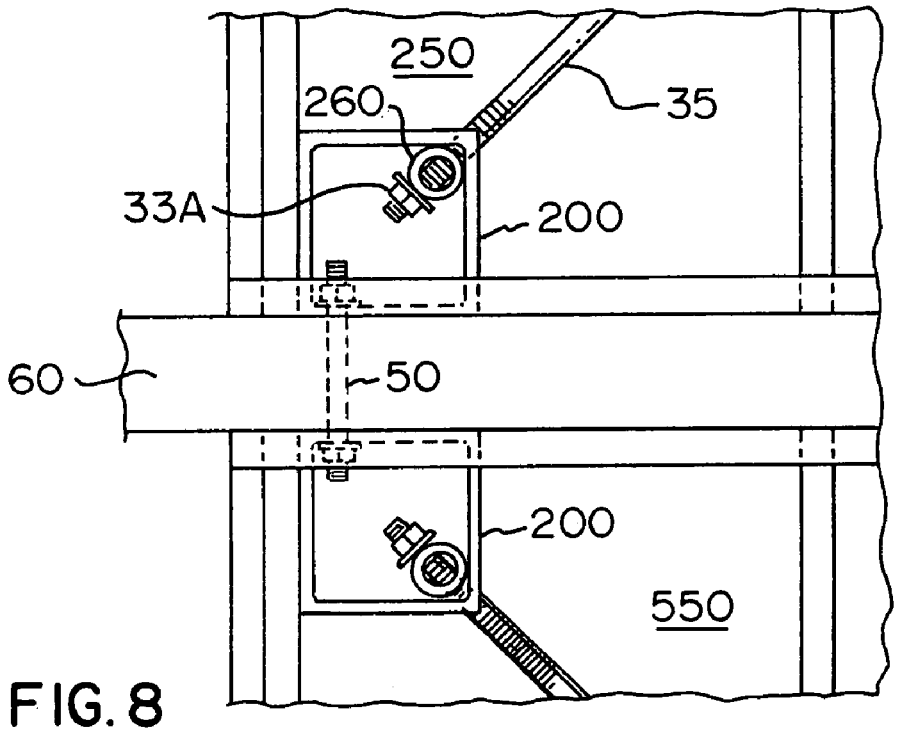
FIG. 8 is an elevational view of another embodiment of the structure illustrated in FIG. 5 having two panels and a slab attached therebetween.

FIG. 8 illustrates a panel 250 utilizing a bracket 200 similar to the bracket 200 in FIG. 7. Panel 250 may be mounted upon a horizontal structural slab 60 and secured thereto through a connecting member 50 extending through the bracket and into the horizontal slab 60. Additionally, a second panel 550 may be mounted upon the underside of the horizontal slab 60 using another bracket 200 which is secured to the same connecting member 50. It should be appreciated that this pattern may be repeated for multiple slab/bracket combinations such that a building may be assembled comprised of a structure having multiple horizontal load-bearing slabs or other floor systems as previously described and structural panels mounted thereupon and connected to each other on opposite sides of the slab.

Figure 9:
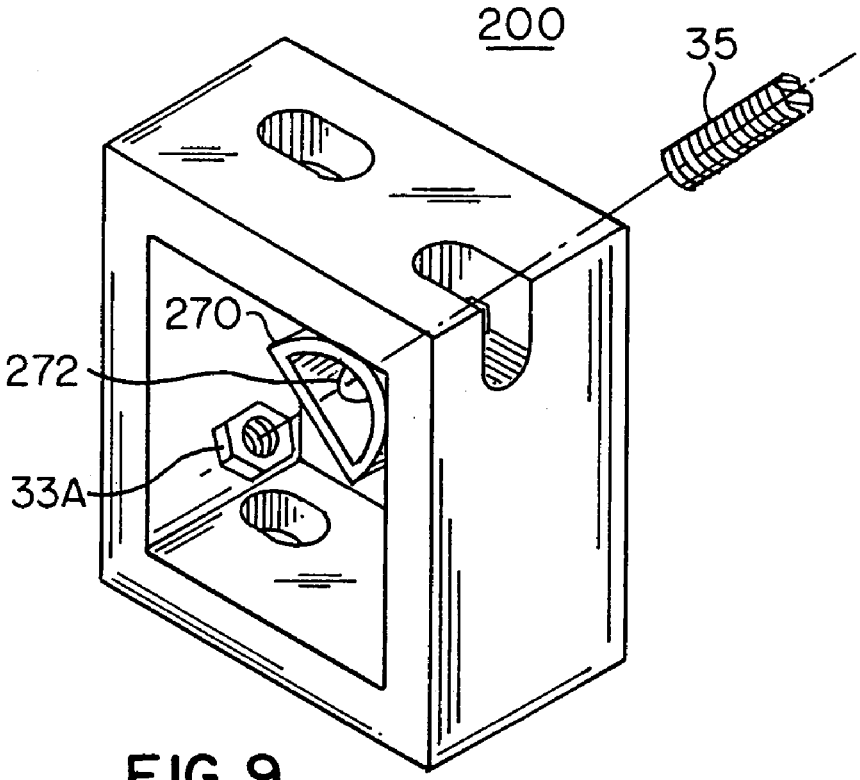
FIG. 9 is a perspective view of still another embodiment of the bracket in accordance with the subject invention.

FIG. 9 illustrates the same bracket 200 illustrated in FIG. 7 with only a single modification. Instead of the cylinder 260 or hillside washer illustrated in FIG. 7, a D-shaped member 270 having a bore 272 to accept the cross member 35 secured by a nut 33A is utilized.

Figure 10:
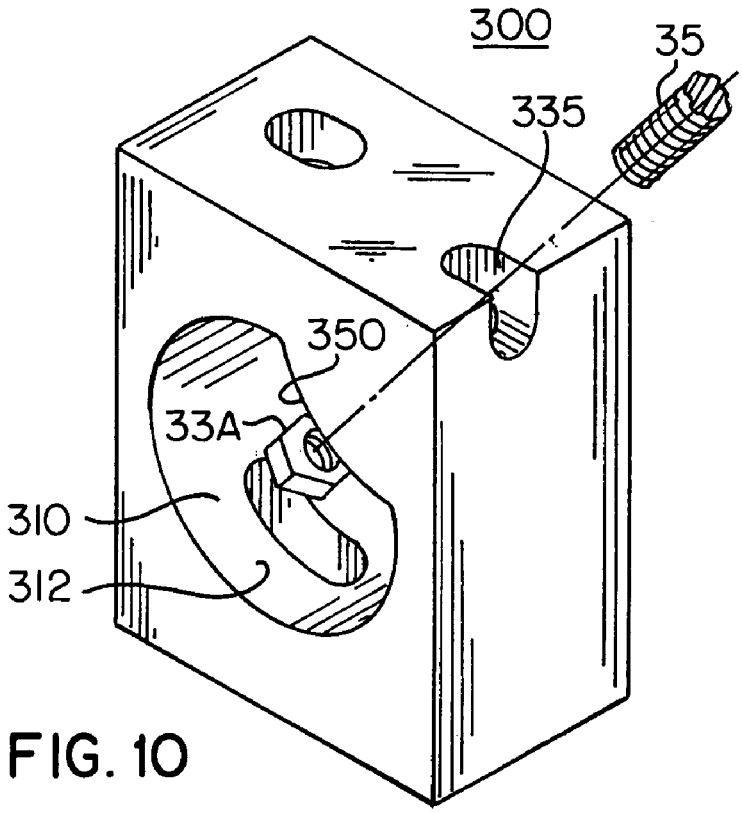
FIG. 10 is a perspective view of yet another embodiment of a bracket made in accordance with the subject invention.

FIG. 10 illustrates yet another bracket 300 having a generally rectangular shape, however having a cavity 310 with a circular shape. Cross member 35 extends through the first passageway 335 and is secured by a nut 33A. The cavity wall 312 has a convex shape 350 to provide the nut 33A with a tangential contact point at the cavity wall 312.

Figure 11:
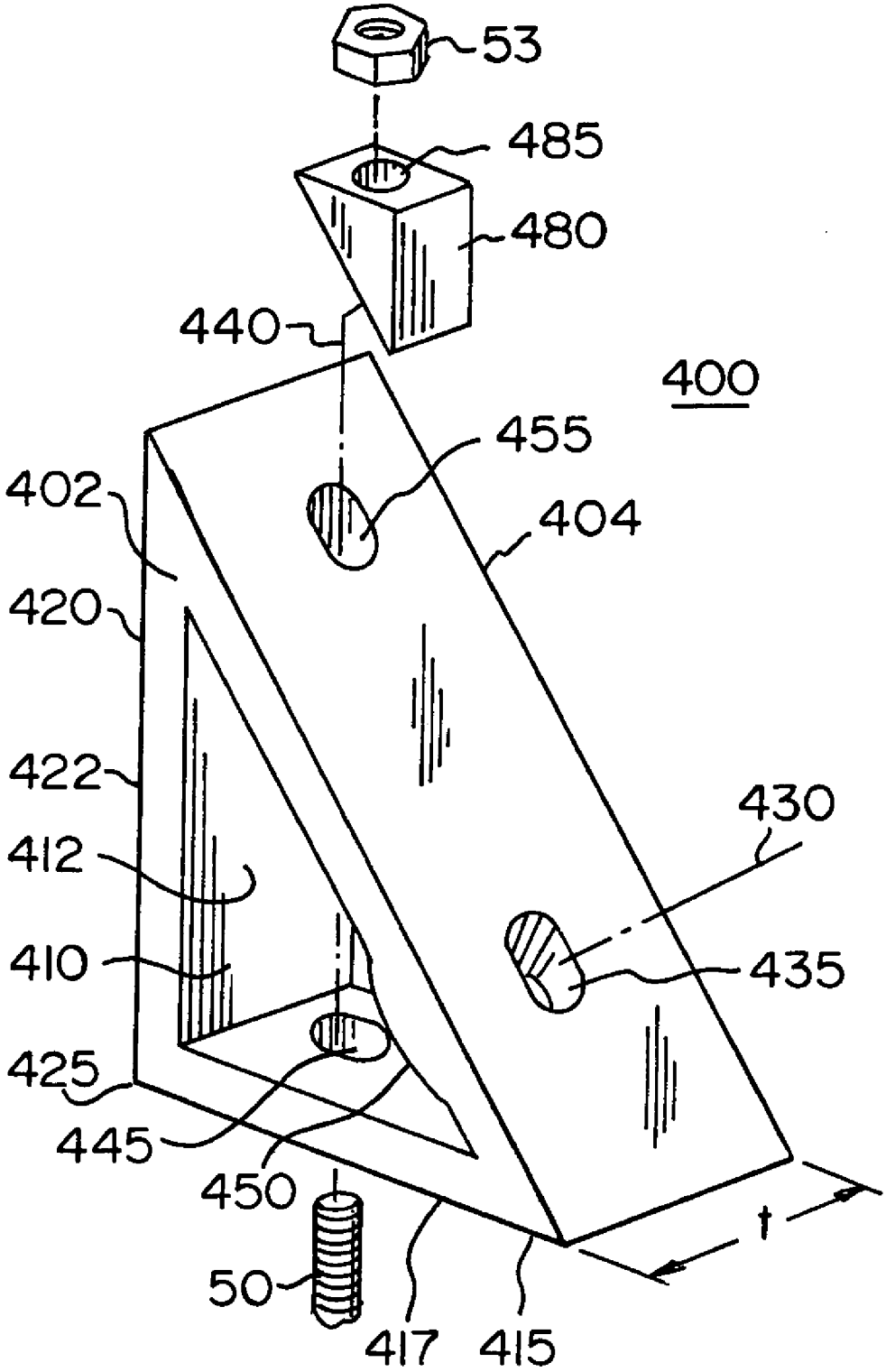
FIG. 11 is a perspective view of yet another embodiment of a bracket made in accordance with the subject invention.

FIG. 11 illustrates a bracket 400 comprised of a polygon having a first side 402 and a second side 404 with a thickness t therebetween. A cavity 410 extends therethrough to further define a cavity wall 412. The polygon is a triangle and the cavity 410 also has the shape of a triangle. The bracket 400 has a first end 415 and a second end 420 adjacent to the first end 415. The first end 415 and the second end 420 each have mutually perpendicular outer surfaces 417, 422 and each outer surface 417, 422 extends or may be projected to extend to intersect with the other outer surface to form a base corner 425. An imaginary first penetration line 430 extends from the base corner 425 away from both the first end 415 and the second end 420. The first penetration line 430 intersects and passes through the cavity wall 412 opposite the base corner 425 and forms an angle with the outer surface 417 of the first end 415 of between 30 to 60° similar to angle A illustrated in FIG. 4.

A first passageway 435 extends about the first penetration line 430 through the cavity wall 412. The cavity wall 412 surrounding the first passageway 435 may have a convex shape as illustrated by convex shape 450. An imaginary second penetration line 440 extends from and in a direction perpendicular to the outer surface 417 of the first end 415. A second passageway 445 extends about the second penetration line 440 through the cavity wall 412 of the first end 415. A third passageway 455 may extend about the second penetration line 440 and through the cavity wall 412 opposite the second passageway 445. Connecting member 50 may be secured with a nut 53 against the inclined surface of the bracket 400 utilizing a wedge 480 having a bore 485 extending therethrough to accept the connecting member 50. Additionally, connecting member 50 may be secured with the nut 53 against the cavity wall 412 in the region of the second passageway 445, thereby eliminating the need for wedge 480.

It can be appreciated now that a method for fabricating a building using prefabricated steel panels may be comprised of multiple steps using brackets described herein. First of all, a bracket 100A (FIG. 1) may be secured within each inner corner of the steel panel 10, wherein the steel panel is defined by a first track 12, a second track 15 and a plurality of studs 20A–20F. The brackets are secured to the panel at the base corners defined at the intersection of the first track 12, the second track 15 and the outermost vertical studs 20A, 20F. Each track is connected to a diametrically opposing track with a tension adjustable connector to form a first panel assembly.

These steps may be repeated to form a second panel 70 (FIG. 5). The first panel 10 is now positioned on one side of a first horizontal slab 60, while the second panel 70 is positioned on the other side of the horizontal slab 60. The first panel 10 is now secured to the second panel 70 using a connecting member 50 extending through the slab 60 and connected to one bracket 100A in each panel 10, 70. The connecting members 50 are threaded so that brackets 100A and 100E may be secured to one another through the horizontal slab 60. Additional slabs with associated panels may be added to the top of panel 10 and to the bottom of panel 70 as may be needed to fabricate a mutli-story structure.

Another aspect of the present invention is to provide floor-to-floor connections for structural panels utilizing brackets, such as, but not limited to those disclosed in the subject invention.

Directing attention to FIG. 5, after a structural panel 70 is secured to a support surface (not shown), decking in the form of a metal profile member 52, may be secured to the top surface 72 of the panel 70. Utilizing this method, easy installation of floor-to-floor connecting members 50 prior to a concrete pour is made possible. In particular, once a metal profile member 52 is secured to the top surface 72 of the panel 70, at least one threaded connecting member 50 may be passed through the top surface 72 of the panel and the metal profile member 52. Concrete may then be poured on the metal profile member 52 thereby embedding the upper end 51 (not shown) of the threaded connecting member 50 in the concrete. With respect to FIG. 5, the connecting member 50 is positioned such that the connecting member 50 is lower than the top surface 62 of the poured structural slab. After the concrete partially hardens, thereby providing a semi-hard top surface 62, the threaded connecting member 50 is rotated, or advanced in another fashion, such that it penetrates the top surface 62.

By permitting the concrete to partially harden over the embedded connecting member 50 and then advancing the connecting member 50 through the top surface 62, the concrete surrounding the connecting member 50 is planar and level. In the alternative, when the concrete is permitted to fully harden around an already protruding connecting member 50, the concrete bulges in the area adjacent to the connecting member 50 thereby requiring at least one additional operation, such a grinding to produce a planar and level surface adjacent to the connecting member 50. This is important since the panel 10 that may rest upon the top surface 62 of the concrete requires a flat surface. By utilizing this method, a panel may be secured upon the concrete surface 62 and attached to the upper end 51 of any connecting member 50. This process may be repeated for multiple panels secured upon the structural slab 60 and for multiple floors within a building.

The invention has been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A structural panel comprising:

a) a first track;

b) a second track;

c) a plurality of elongated members therebetween connected to and securing the first track to the second track, wherein intersections of outermost elongated members and the first track and the second track define four inner corners;

d) at least one pair of brackets wherein each bracket of said pair is secured to one of two diametrically opposed inner corners, each of said brackets comprised of a pentagon shaped body with a first side and a second side defining a thickness with a cavity extending therethrough to further define a cavity wall, a first end and a second end, wherein the first end and the second end each have mutually perpendicular outer surfaces, wherein an imaginary first penetration line extends away from both the first end and the second end and wherein the first penetration line intersects and passes through the cavity wall, wherein a first passageway extends about the first penetration line through the cavity wall, wherein an imaginary second penetration line extends from and in a direction perpendicular to the outer surface of the first end, wherein a second passageway extends about the second penetration line through the cavity wall of the first end, and wherein the cavity wall surrounding the first passageway has a convex shape, a third passageway through the cavity wall positioned opposite the second passageway, wherein the second penetration line passes through the third passageway, each of said brackets being a continuous, unitary member;

e) a cross member passing through the first passageway of one of the pair of brackets and secured at a first end to the one of the pair of brackets and the cross member passing through the first passageway of the other of the pair of brackets and secured at a second end to the other of the pair of brackets; and f) the second passageway of each of the pair of brackets adapted for receiving a connecting member.

2. The structural panel according to claim 1, wherein the imaginary first penetration line forms an angle of between 30–60° with the outer surface of the first end.

3. The structural panel according to claim 2, wherein the angle is 45°.

4. The structural panel according to claim 1, wherein the first passageway is biased toward the first side.

5. The structural panel according to claim 1, wherein there are two pairs of brackets.

6. The structural panel according to claim 1, wherein each bracket is welded to one of either a top or second track and to the adjacent outermost stud.

7. The structural panel according to claim 1, wherein each cross member has threaded ends which extend through the first passageways in the brackets and are secured to the brackets with mating nuts, which coact with the cavity walls surrounding the first passageways, such that the tension in the cross member may be adjusted by tightening or loosening the nuts against the brackets.

8. The structural panel according to claim 7, further including washers on each cross member between the nuts and the cavity walls surrounding the first passageways in the brackets.

9. The structural panel as claimed in claim 8, wherein said washer contacts the cavity wall and is tangent thereto.

10. The structural panel as claimed in claim 1, wherein said first passage is elongated so that the cross member may be received by the first passageways in a plurality of angles relative to the first imaginary penetration line of the brackets.

11. The structural panel as claimed in claimed in claim 1, wherein the elongated members comprise studs.

12. A structural panel comprising:

a) a first track;

b) a second track;

c) a plurality of elongated members therebetween connected to and securing the first track to the second track, wherein intersections of outermost elongated members and the first track and the second track define four corners;

d) four brackets, each of said brackets being a continuous, unitary member that defines a cavity, one bracket secured to a respective corner, the four brackets defining two pairs of diagonally spaced brackets, each of the brackets defining a cavity, each of said brackets having a first passageway, a second passageway, and a third passageway that communicate with the cavity, wherein a first penetration line extends through the first passageway and a second penetration line extends through the second and third passageways, the second passageway spaced away from the third passageway by the cavity, the second passageway positioned adjacent one of the first track and the second track; and e) two cross members, each cross member having two end portions, the end portion of each of the cross members received in a respective one of the bracket cavity, each cross member secured to a respective bracket of the pair of the brackets, wherein each of the cross members end portions coacts with a respective bracket of the pair of brackets through a convex-shaped surface defined on the bracket, the first passageway passes through the convex-shaped surface, each of the cross members extends along a respective one the first penetration lines of the brackets to which the cross members coact.

13. The structural panel according to claim 12, wherein the brackets have a first side and a second side, defining the thickness of the brackets, wherein the first passageways are biased toward the first side.

14. The structural panel as claimed in claim 12, wherein the panel cross members are tensioned resulting in a structural post-stressed member for use on a multi-storage building.

* * * * *